United States Patent [19]

Weers et al.

[11] Patent Number: 4,900,427

[45] Date of Patent: Feb. 13, 1990

[54] ANTIFOULANT COMPOSITIONS AND METHODS

[75] Inventors: Jerry J. Weers, Ballwin; Thomas J. Falkler; George G. Duggan, both of Fenton; Robert J. Garrecht, St. Louis, all of Mo.

[73] Assignee: Petrolite Corporation, St. Louis, Mo.

[21] Appl. No.: 383,941

[22] Filed: Jul. 21, 1989

[51] Int. Cl.[4] ..... C10G 9/16; C10G 9/21

[52] U.S. Cl. ..... 208/48 AA; 252/51.5 R; 585/13; 208/255; 208/14; 423/DIG. 14; 44/63

[58] Field of Search ..... 208/48 AA, 14; 252/51.52, 33.4, 34, 394; 44/63, 72; 585/950

[56] References Cited

U.S. PATENT DOCUMENTS

| | | | |
|---|---|---|---|
| Re. 26,330 | 1/1968 | Colfer | 208/48 AA |
| 2,962,442 | 11/1960 | Andress, Jr. | 208/48 AA |
| 3,390,073 | 6/1968 | Godar et al. | 208/48 AA |
| 3,756,943 | 9/1973 | Hopkins et al. | 208/48 AA |
| 3,868,329 | 2/1975 | Brown et al. | 252/515 R |
| 3,872,019 | 3/1975 | Culbertson et al. | 252/515 R |
| 4,285,824 | 8/1981 | Bryant | 252/515 R |
| 4,440,625 | 4/1984 | Go et al. | 252/515 R |
| 4,749,468 | 6/1988 | Ruliny et al. | 208/48 AA |
| 4,810,354 | 3/1989 | Roling et al. | 208/14 |

*Primary Examiner*—Helane Myers

*Attorney, Agent, or Firm*—Stanley M. Tarter

[57] ABSTRACT

Fouling of heat exchangers in chemical processing or oil refining systems is inhibited by incorporating into a petroleum derived stock an effective antifouling amount of a mixture of (a) a condensation product of an alkylphenol, an aldehyde, and an amine; and (b) a diaminomethane.

12 Claims, No Drawings

ANTIFOULANT COMPOSITIONS AND METHODS

FIELD OF THE INVENTION

The present invention relates to compositions and methods for providing antifouling protection during processing of petroleum hydrocarbons or petrochemicals at elevated temperatures. More particularly, the present invention relates to compositions and methods for providing antifouling protection on hot surfaces of furnaces, heat exchangers, reboilers, condensers, auxiliary equipment, catalyst beds and the like in petroleum refining processes, petrochemical processes and the like.

BACKGROUND OF THE INVENTION

It is well known to treat various oil refinery charge stocks to extract improved fuel values therefrom or to convert them to valuable petrochemicals. A major problem encountered in the treatment of various hydrocarbon charge stocks is the phenomenon recognized and descriptively called fouling. This phenomenon is manifested in the form of deposits which frequently form on the metal surfaces of the processing equipment and tend to naturally decrease the efficiency of the intermediate processing operations. The results of fouling appear in the form of heat transfer loss, pressure drop, loss in throughput rate and an increase in corrosion of the equipment.

The charge stocks which most commonly cause fouling in intermediate refinery equipment are naphthas, gas oils, crude, and petroleum gases. The naphthas or light distillates may be considered as a light oil usually having a boiling point range of 32°-260° C. The gas oils are intermediates between the so-called kerosene fractions and the light lubricating oils, and generally distill in the range of 260°-540° C. Those gas oils are usually used as charges to cracking units where the molecules are broken down into smaller components. The crude oils which most often cause the problem of fouling are charged to the first refining stage operations and contain all the petroleum fractions normally removed in the refining processes. Crude stocks include the residual fraction which remain after the more valuable components and solvent extractable components of the crudes have been removed.

Another class of hydrocarbons where fouling problems arise and which are ameliorated by the method of the present invention is the petroleum gases or normally gaseous alkane and alkene hydrocarbons which normally boil in the range of −250° to 100° C., i.e., methane, ethane, propane, butane, ethylene, propylene, etc. These hydrocarbons may be in the liquefied state or gaseous state during processing thereof in the practice of the method of the present invention.

The various charge stocks mentioned above are most frequently subjected to one or more of the following general type thermal or catalytic processes to produce fuel: fractionation, reforming, cracking, alkylation, isomerization, polymerization, desulfurization, hydrogenation and dehydrogenation.

Similar fouling problems arise in equipment used in the petrochemical industry wherein the hydrocarbon charge stock is, in most cases, heated at normal or elevated temperatures and pressures. For example, acetylene may be produced from light naphtha or natural gas. Ammonia may be produced by mixing a compressed hydrocarbon gas, liquid hydrocarbon or the like with steam. Benzene and hydrogen are reacted to produce cyclohexane. Light alkane hydrocarbons may be used to produce mono-olefins and di-olefins. Ethylene fuel may be heated under pressure to produce ethanol. Light and heavy crude oils, as well as light hydrocarbon gases may be thermally cracked into ethylene, propylene, and $C_4$ olefins.

The foregoing examples of petrochemical processes are illustrations but not exhaustive of processes where fouling problems arise such that the practice of the method of the present invention may be used advantageously.

It is common practice to add chemical agents to the above-mentioned fuel stocks to reduce the fouling of the processing equipment. One known antifoulant is the Mannich condensation product of an alkylphenol, an aldehyde, and an amine.

U.S. Pat. No. 4,166,726 suggests the use of such condensation product as diesel fuel additives to provide improved combustion of such fuel.

U.S. Pat. No. 4,810,354 discloses a method of inhibiting fouling in hydrocarbon processing equipment by using an effective amount of the Mannich condensation product of an alkoxylated alkylphenol, an aldehyde and a polyamine.

It has been found that even with the use of the aforementioned Mannich condensation products, undesirable fouling occurs during the thermal processing of hydrocarbon stocks.

The present invention provides a process for substantially reducing the fouling normally experienced in processing petroleum hydrocarbon liquids at elevated temperatures. Thus, the practice of the present invention inhibits the build-up of deposits in processing equipment that would otherwise reduce throughput capacity.

SUMMARY OF THE INVENTION

Fouling of process equipment is inhibited from occurring by the use in hydrocarbon stock of a combination of antifoulants comprising (a) the condensation product of an alkylphenol or alkoxylphenol, an aldehyde, and an amine; and (b) a diamine having the chemical structure of:

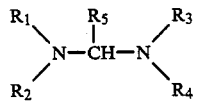

wherein $R_1$, $R_2$, $R_3$, and $R_4$ are each independently an alkyl radical containing 1-14 carbon atoms, $(CH_2)_n$—$OR_6$ or cycloalkyl having 5 or 6 carbon atoms or wherein $R_1$ and $R_2$ and/or $R_3$ and $R_4$ are alkylene groups joined together with their adjacent N atom to form a saturated heterocyclic ring and wherein $R_5$ is hydrogen or methyl and $R_6$ is an alkyl having 1 to 5 carbon atoms and n is an integer of 2 to 5.

The weight ratio of component (a) to component (b) is in the range of 1:100 to 100:1.

DETAILED DESCRIPTION OF THE INVENTION

It has been found that a combination of additives including (a) the condensation of an alkylphenol or alkoxyphenol, an aldehyde, and an amine; and (b) certain diaminomethane compounds provide excellent antifoulant activity in hydrocarbons and petrochemicals during thermal processing thereof where process temperatures may range from 35°–540° C., normally 260°–540° C.

The alkylphenols and/or alkoxyphenols useful in preparing the Mannich condensation product are of the formula:

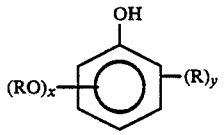

wherein R may be a straight or branched chain alkyl radical having 1 to 100 carbon atoms and preferably from 10 to 30 carbon atoms. x and y are independently selected integers which together total 1 to 5. The R and RO groups may be present on any or all the sites around the phenolic ring, i.e., ortho, meta or para. Preferably, the R groups will predominantly be meta or para. More than about 40% of the R and RO groups will be in the ortho position and preferably less than 15% of the R or Ro groups will be in the ortho position. Particularly preferred alkylated phenols include p-nonylphenol and dodecllphenol. Also preferred is p-methoxyphenol and p-methyoxy-o-tertbutylphenol.

The amines suitable for use in the condensation reaction contain one or more amino groups and at least one active hydrogen atom. Suitable amines include primary amines and secondary amines. Examples include the primary alkyl amines such as methyl amine, ethyl amine, n-propyl amine, isopropyl amine, n-butyl amine, isobutyl amine, 2-ethylhexyl amine, dodecyl amine, stearyl amine, and the like. Also, dialkyl amines may be used, such as dimethyl amine, diethyl amine, methylethyl amine, methylbutyl amine, and the like. Also, polyfunctional amines, such as N,N-dimethylaminopropylamine, 3-methylaminopyridine, ethyl-4-aminopentylamine, N-(2'-aminoethyl)-piperidine, including mixtures are useful. Also useful are alkylenepolyamines of the formula:

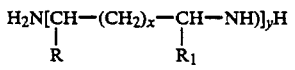

wherein x and y are independently selected integers of 0–15 with the proviso that the sum of x+y is at least one, R and $R_1$ are independently selected from the group of hydrogen, alkyl, aryl, aralkyl, or alkaryl having from 1 to 20 carbon atoms. Exemplary polyamines which can be used in the preparation of the condensation product include ethylene diamine, propylenediamine, diethylenetriamine, triethylenetetraamine, tetraethylenepentamine, bishexamethylenetriamine, and the like. The preferred amines include methyl amine, ethylenediamine and triethylenetetraamine.

Aldehydes having the following formula are suitable for use in the condensation reaction product:

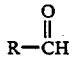

wherein R is selected from hydrogen and alkyl radicals containing 1–6 carbon atoms. Examples of suitable aldehydes include formaldehyde, acetaldehyde, propanaldehyde, butylaldehyde, hexaldehyde and heptaldehyde. The preferred aldehyde is formaldehyde.

The Mannich condensation reaction may proceed at temperatures from about 50°14 200° C. with the preferred temperature range being about 75°14 75° C. The time required for completion of the condensation reaction may vary from about 1–8 hours, varying with the specific reactants chosen and the reaction temperature.

The molar range of alkylated and/or alkoxylated phenol, formaldehyde and amine employed generally ranges from 0.5–5 molar parts of formaldehyde per molar part of alkylated phenol. Preferably, the molar ratio of the phenol to amine to aldehyde varies from 1:1–5:2–5 and more preferably from 1:1–1.5:2–3. For the use of a diamine a ratio of 1:1:2 is theoretical.

The diaminomethanes which are suitable for use in the present invention have the following chemical structure:

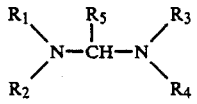

wherein $R_1$, $R_2$, $R_3$, and $R_4$ are each independently an alkyl radical containing to 1 to 14 carbon atoms, $(CH_2)_n$—$OR_6$ or cycloalkyl having 5 or 6 carbon atoms and $R_5$ is hydrogen or methyl. $R_6$ is an alkyl having 1 to 5 carbon atoms and n is an integer of 2 to 5. Additionally, $R_1$, $R_2$, $R_3$, and $R_4$ can be a lower alkylene wherein $R_1$ and $R_2$ alone and/or wherein $R_3$ and $R_4$ are joined together to form a five or six member saturated heterocyclic ring. Such ring can also contain hetero atoms such as N, O, or S in addition to the N to which $R_1$ and $R_2$ and/or $R_3$ and $R_4$ are respectively joined together to form, for example, a piperazino ring or morpholino ring. The heterocyclic compounds comprising one additive of the combination of antifouling additives of the present invention have the following structure:

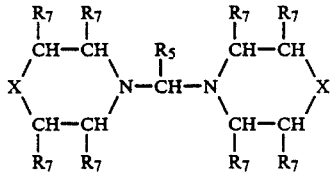

where X is selected from the group of NH, O, S, or —$CHR_6$ and $R_5$ is hydrogen or methyl and each $R_7$ is independently hydrogen or $C_1$–$C_4$ alkyl and $R_6$ is hydrogen or $C_1$–$C_4$ alkyl.

The diaminomethanes useful in the present invention can be prepared by reacting a suitable aldehyde and a suitable secondary amine or mixtures in a known and conventional manner. Thus, the diaminomethanes can be obtained by reacting a secondary amine typically having the formula:

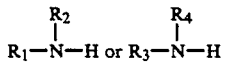

with an aldehyde having the formula:

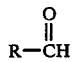

in which $R_1$, $R_2$, $R_3$, and $R_4$ are each independently an alkyl radical containing to 1 to 14 carbon atoms, $(CH_2)_n$—$OR_6$ or cycloalkyl having 5 or 6 carbon atoms, $R_6$ is an alkyl having 1 to 5 carbon atoms and n is an integer of 2 to 5. Additionally, $R_1$, $R_2$, $R_3$, and $R_4$ can be a lower alkylene wherein $R_1$ and $R_2$ alone and/or $R_3$ and $R_4$ are joined together to form a five or six member saturated heterocyclic ring. R is hydrogen or an alkyl radical having 1 to 6 carbon atoms. The secondary amine and the aldehyde are preferably combined in a mole ratio of about 2:1 , i.e., the stoichiometric amount for the formation of diaminomethane with substantially no side products.

The diaminomethanes useful in the present invention can be prepared under conventional dehydrating conditions whereby water is removed by any suitable means. Typically, the aldehyde is added to the secondary amine and the condensate recovered by mechanically separating as much of the water of reaction as possible and distilling off the remaining water. The reaction is generally exothermic and the exotherm should be controlled particularly when the aldehyde is other than formaldehyde to prevent formation of enamines. The subject diamines can be formed from mixtures of different aldehydes and/or mixtures of different secondary amines.

The additive composition of the present invention containing the two components, namely a Mannich condensation product and a diaminomethane, may be dispersed within the hydrocarbon stock within the range of 0.5 to 25,000 ppm, preferably 10–10,000 ppm. The proper concentration of components will vary depending on the particular composition of hydrocarbon stock, the presence of other additives and the like.

The invention will now be further disclosed in the following illustrated examples wherein parts and percentages are given on a weight basis unless otherwise specified.

EXAMPLE 1

In this example, a Mannich condensation product of an alkylphenol, an aldehyde, and a diamine was prepared.

Forty-four parts of p-nonylphenol, 12 parts of ethylene diamine, and 60 parts of xylene were mixed in a flask and heated at 60°–70° C. for 30 minutes. 32.4 parts of 37% aqueous solution of formaldehyde was added dropwise to the mixture over about a 20 minute period. Then, the resulting mixture was heated at 80°14 90° C. for one hour. Water of reaction and xylene was distilled from the flask by heating the mixture. Heating of the mixture was continued until a product temperature of 150° C. was obtained. Thereupon, the resulting condensate was cooled.

EXAMPLE 2

In this example, bis(di-n-butylamino)methane was prepared.

Two moles of dibutylamine was heated to 80° C. Then, one mole of formaldehyde in the form of 37% aqueous solution was then added dropwise to the heated amine. After completing the addition of the formaldehyde, the resulting mixture was stirred at room temperature for 15 minutes. Thereafter, water was removed by rotary evaporation. The resulting product was identified as bis(di-n-butylamino)methane.

EXAMPLE 3

In a naphtha hydrodesulfurization unit of a large commercial oil refinery, it was noted that an inordinate amount of deposits built-up on heat exchangers used in such unit in a relatively short period of time.

The efficiency of the heat transfer was so adversely affected that the unit had to be shut down and deposits removed from the heat exchangers in less than 100 days of operation. However, when 25 ppm of a mixture of 3 parts of the Mannich condensation product of Example 1 and 1 part of the diaminomethane compound of Example 2 was added to the same feed to the same unit, the efficiency of the heat transfer had not been adversely affected requiring a shut down of the unit even after over 200 days of normal operation of the unit.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth hereinabove but rather that the claims be construed as encompassing all the features of patentable novelty which reside in the present invention, including all features which would be treated as equivalents thereof by those skilled in the art to which the invention pertains.

What is claimed is:

1. A process of inhibiting fouling of heat exchangers in chemical processing or oil refining systems comprising incorporating into a petroleum derived stock an effective antifouling amount of a composition comprising (a) a condensation product of an alkylphenol and/or alkoxyphenol, an aldehyde and an amine; and (b) a diaminomethane;

the weight ratio of component (a) to component (b) being in the range of 1:100 to 100:1.

2. A process of inhibiting fouling of heat exchangers in chemical processing or oil refining systems comprising incorporating into a petroleum derived stock an effective antifouling amount of a composition comprising (a) a Mannich condensation product of an alkylphenol, an aldehyde and an amine, the molar ratio of the phenol to the amine to aldehyde being in the range of 1:1–5:2–5; and (b) a diaminomethane;

the weight ratio of component (a) to component (b) being in the range of 1:100 to 100:1 .

3. The process of claim 1 wherein the phenol has the structural formula:

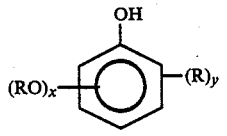

wherein R is an alkyl group having 1–100 carbon atoms and x and y are independently selected integers which together total 1–5.

4. The process of claim 3 wherein the molar ratio of phenol to aldehyde to amine is in the range of 1:1–1.5-:2–3.

5. The process of claim 4 wherein the phenol is p-nonylphenol or dodecylphenol.

6. The process of claim 3 wherein the aldehyde has the structural formula:

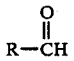

wherein R is selected from hydrogen and alkyl radicals containing 1–6 carbon atoms.

7. The process of claim 6 wherein the aldehyde is formaldehyde.

8. The process of claim wherein the amine is a primary amine or secondary amine.

9. The process of claim 8 wherein the amine is a polyamine having the structural formula:

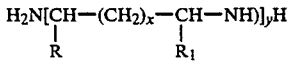

wherein x and y are independently selected integers of 0–15 with the proviso that the sum of x+y is at least one, R and $R_1$ are independently hydrogen, alkyl, aryl, aralkyl, or alkaryl having 1 to 20 carbon atoms.

10. The process of claim 9 wherein the polyamine is ethylene diamine.

11. The process of claim 1 wherein the diaminomethane has the structural formula:

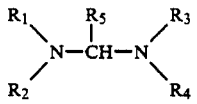

wherein $R_1$, $R_2$, $R_3$, and $R_4$ are each independently an alkyl containing 1 to 14 carbon atoms, $(CH_2)_n$—$OR_6$ or cycloalkyl having 5 or 6 carbon atoms or wherein $R_1$ and $R_2$ and/or $R_3$ and $R_4$ are lower alkylene groups joined together with their adjacent N atom to form a saturated heterocyclic ring and $R_5$ is hydrogen or methyl and $R_6$ is an alkyl having 1 to 5 carbon atoms and n is an integer of 2 to 5.

12. The process of claim 11 wherein the diaminomethane is bis(di-n-butylamino)methane.

* * * * *